US006936305B1

(12) United States Patent
Biagiotti

(10) Patent No.: US 6,936,305 B1
(45) Date of Patent: Aug. 30, 2005

(54) METHOD AND EQUIPMENT FOR PRODUCING ROLLS OF MOISTENED WEB MATERIAL

(75) Inventor: Guglielmo Biagiotti, Lucca (IT)

(73) Assignee: Fabio Perini S.p.A, Lucca (IT)

( * ) Notice: Subject to any disclaimer, the term of this patent is extended or adjusted under 35 U.S.C. 154(b) by 68 days.

(21) Appl. No.: 10/148,317

(22) PCT Filed: Nov. 28, 2000

(86) PCT No.: PCT/IT00/00484

§ 371 (c)(1),
(2), (4) Date: May 29, 2002

(87) PCT Pub. No.: WO01/40575

PCT Pub. Date: Jun. 7, 2001

(30) Foreign Application Priority Data

Dec. 2, 1999 (IT) ..... FI99A0246

(51) Int. Cl.[7] ..... B05D 3/00; B05D 3/12; B05C 11/00

(52) U.S. Cl. ..... 427/177; 427/179; 427/180; 427/203; 427/289; 427/290; 427/356; 427/358; 427/402; 118/38; 118/123; 118/419; 118/235

(58) Field of Search ..... 427/177, 179, 427/180, 356, 358, 203, 289, 290, 402, 421.1, 427/428.01, 439, 430.1; 118/38, 123, 419, 118/235, 400, 300

(56) References Cited

U.S. PATENT DOCUMENTS 3,791,907 A * 2/1974 Marcalus ..... 156/253
5,439,521 A * 8/1995 Rao ..... 118/415
5,525,345 A * 6/1996 Warner et al. ..... 424/402

FOREIGN PATENT DOCUMENTS

WO WO 99/02083 A1 1/1999

* cited by examiner

*Primary Examiner*—Katherine Bareford
(74) *Attorney, Agent, or Firm*—Breiner & Breiner, L.L.C.

(57) ABSTRACT

Equipment for producing rolls of wound web material including a feed path for the web material, winding structure for winding the web material and forming the rolls, and along the feed path and upstream from the winding means, an applicator member for applying to the web material fed along the path a dry component of a component with a low liquid content of a liquid-based mixture, with which the wound web material is impregnated.

11 Claims, 2 Drawing Sheets

METHOD AND EQUIPMENT FOR PRODUCING ROLLS OF MOISTENED WEB MATERIAL

TECHNICAL FIELD

The present invention relates to a method for producing articles consisting of a soaked or moistened sheet product.

PRIOR ART

At the present time, freshening, disinfecting or cleaning wipes are produced, consisting of sheets of absorbent paper material soaked in an aqueous solution of detergents, soaps, perfumes, or other substances. Normally, these wipes are folded and packaged individually in sealed sachets. In some cases, multiple packs are produced, containing a plurality of moistened wipes which can be drawn singly from the pack.

OBJECTS AND SUMMARY OF THE INVENTION

The object of the present invention is to provide a method and equipment for producing rolls of web material, for example, but not exclusively, of the paper type, soaked or moistened with aqueous substances containing detergents, soaps, perfumed oils, disinfectants, or other substances.

Essentially, the method according to the invention comprises the stages of:

- feeding the web material towards a winding area;
- applying to said fed web material, upstream from the winding area, at least one dry component or a component with a low liquid content of a liquid-based mixture;
- winding, in the winding area, the web material to which the aforesaid component has been applied, to form a roll of web material;
- moistening the wound web material with a liquid to form said liquid-based mixture.

Thus, the web material, which typically consists of a layer or a number of joined layers of paper material, is treated with a component which does not significantly reduce the strength of the web material. This material can therefore be correctly fed to the winding area without being damaged.

Additionally, this method makes it possible to carry out what is known as the changeover with the web material in an essentially dry state. In a rewinding machine, the term "changeover" denotes the stage in which the web material, supplied continuously, is interrupted by tearing or cutting on completion of the winding of a roll, and the winding of a new roll is started with the free leading end which is thus formed.

The invention can easily be implemented in existing rewinding machines, without the need to modify the machines, thus enabling a product in moistened sheet form to be produced.

The liquid phase of the mixture with which the final product is soaked is applied principally or exclusively after the web material has been wound into rolls, and therefore has no effect on the mechanical strength which is essential at the winding stage. Moreover, since the liquid component can also be alcohol-based or contain volatile substances in general, its application before the winding of the web material into rolls would cause at least partial evaporation of the liquid and therefore a reduction of the liquid content in the finished product.

The application of the liquid component (or at least the greater part of it) after the production of the roll reduces the number of mechanical components of the production line which come into contact with the liquid and therefore have to be made from materials resistant to the corrosion or other harmful effects due to the action of the liquid.

On the other hand, some substances such as soaps, oils, emollients and others, pass with difficulty through the fibers making up the web material, or do not pass through the fibers at all, and therefore if these substances were in suspension or in a mixture with the liquid component and the web material were soaked in the liquid mixture only after winding, the inner turns of the web material would receive only the liquid component and not the other substances, which would remain on the outside of the roll because of the filtering effect of the fibers, or in any case would receive proportions of substances decreasing progressively from the periphery to the interior of the roll.

The method according to the present invention overcomes all these disadvantages and makes it possible to produce a web material wound in rolls in which the whole roll is uniformly soaked, with an approximately constant composition from the periphery to the core.

It will be clearly understood from the above that the component which is applied before winding can also contain a percentage of liquid and does not necessarily have to be anhydrous, in other words free of water or liquid substances in general. On the other hand, it is important that any content of liquid substances is low enough not to reduce the mechanical strength of the web material to an unacceptable extent before winding. In this respect, the method according to the invention is essentially based on the idea of adding most of the liquid component after winding, but it is not essential for the purpose of obtaining the advantages of the invention that all of the liquid part be added after winding.

Similarly, there is no reason why the liquid component should not contain other additional substances, for example perfume essences, at the time of its application. However, the products concerned will generally be those which can easily penetrate through the fibers of the web material and/or those which can easily be dissolved in the liquid, and which are therefore not filtered by the fibers and separated from the liquid phase.

The liquid used can be simply water, alcohol, mixture of alcohols, or mixtures of alcohols and water or other suitable liquid components, which will be chosen according to the specific uses for which the wound material is intended.

The component with a low liquid content can be applied by any suitable method, according to the nature, consistency, viscosity, water content, and physical and chemical characteristics of the component or of the mixture of components. The application can be carried out by spreading with a doctor blade, by roller, by overflow, by spraying, or by other suitable methods.

The liquid component can be applied, for example, by immersing the rolls in a tank containing the liquid, or by another suitable method, for example by spraying, by dripping, or other methods, which can depend on the quantity of liquid which the material is to receive and on the greater or lesser degree of absorption of the web material used. In general, the term "moistening" denotes, in the widest sense, the addition of a liquid component to the wound web material, the quantity of liquid being variable. The final product can be only slightly moistened or completely saturated with liquid, according to the uses for which the product is intended and also according to the type of packaging.

Before packaging, the liquid-impregnated material can be drained or partially dried to eliminate the excess liquid.

The invention also relates to equipment for producing rolls of wound web material, comprising a path for feeding the web material and winding means for winding said web material and forming said rolls, characterized by comprising, along the feed path, upstream of the winding means, an applicator member to apply to the fed web material a dry component or a component with a low liquid content of a liquid-based mixture, with which the wound web material is to be impregnated.

The winding means can comprise a rewinder of what is called the peripheral type, in other words one in which the winding is carried out by means of members rotating in contact with the outer surface of the log or roll being formed; alternatively, it is possible to use rewinders of the shaft type i.e. those known as central rewinders, in which the rotary movement of the roll is produced by means of an axial shaft.

The roll which is formed can be of the type with a tubular winding core, which is advantageously made from non-absorbent material in order to keep the retention of liquid constant even in the innermost turns of the roll. Preferably, however, the roll is of the type without a central winding core. This avoids the impregnation of the board from which the central core normally made. In the case of coreless rolls, these can also be made by winding them on an extractable shaft.

Further embodiments of the method and the equipment according to the invention are indicated in the attached dependent claims.

BRIEF DESCRIPTION OF THE DRAWINGS

The invention will be more clearly understood from the description and the attached drawing, which shows a non-restrictive practical example of the invention. More particularly.

DETAILED DESCRIPTION OF AN EMBODIMENT

Figure 1:
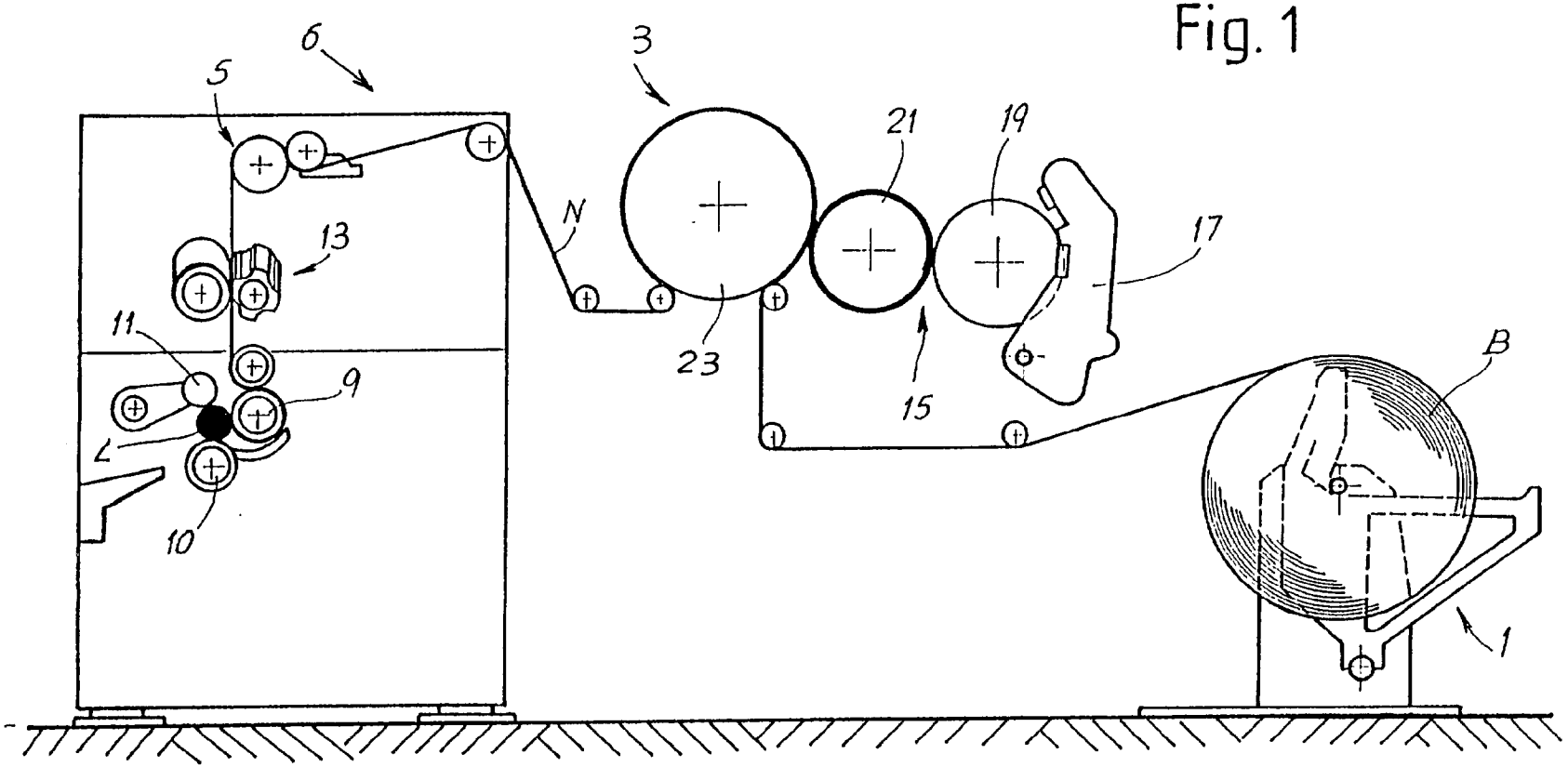
FIG. 1 shows a diagram of the equipment for unwinding and rewinding the web material, in a lateral view.

FIG. 1 shows in a highly schematic lateral view a rewinding line for a web material N taken from a parent reel B carried by an unwinder indicated in a general way by the number 1. The web material N can be of the single- or multiple-layer type. In the second case, the multiple layers can be taken from a single parent reel on which the multiple-layer material is wound, or can be formed by joining single layers taken from a plurality of reels which are unwound simultaneously.

The web material unwound from the reel B is fed through a spreading station 3, which is described in more detail below, and then to a winding station 5 located in a winding area indicated in a general way by 6.

The winding station comprises, in the illustrated embodiment, a rewinder of the peripheral type, in other words one in which the web material is wound into logs or rolls by means of a winding cradle formed by winding members which keep the roll rotating by contact with its outer surface. In the illustrated case, the winding cradle is formed by a set of three winding rollers 9, 10, 11. The roll being wound is indicated by L. Upstream from the set of three winding rollers 9, 10, 11 there is placed a perforator 13 which perforates the web material N along perforation lines which delimit portions or sheets of material which can be detached by tearing.

The rewinder illustrated is of the type described in U.S. Pat. No. 5,639,046, to which reference should be made for further details, which will not be described here since they are not relevant for the purposes of the present invention. Rewinders of another type can be used for the purposes of the present invention, which can be applied conveniently without limitations as to the type of rewinder.

In the spreading station 3, a component or a mixture of components with a low content of liquid (which may be water, alcohol, a mixture of alcohols, a mixture of water and alcohols, or another mixture), or even an essentially dry component or mixture of components, is applied to at least one face of the web material N. The spreading is carried out by an applicator member 15 comprising a feeder 17 interacting with a first collecting cylinder 19, which in turn interacts with a spreading cylinder 21 which applies the component or mixture of components fed by the feeder 17 to the web material running around a drum 23. The illustrated arrangement is similar to a flexographic printing system.

The applicator member can be different from that shown. For example, spreading can be achieved by making the web material run across a feed slit from which the component is fed, by overflow for example. Alternatively, application systems of the doctor blade, spray or other types can be used. The applicator member and the process for applying the component or the mixture of components can be of different types, and in general can be selected by a person skilled in the art, possibly according to the nature of the component or of the mixture of components to be applied, for example according to the greater or lesser degree of viscosity, or to the content of liquids, oils, fats or other substances, if any.

It is also possible to use two applicator members to apply the component or the mixture of components (which may be different from each other) to both faces of the web material. Two or more successive applicators can be used to apply different products to the same face in succession or to different faces.

The rolls or logs L produced by the winding station are subsequently soaked with water, or with an aqueous or alcohol-based mixture, or in any case a liquid, before or after being cut into small rolls of the correct size for the final packaging.

Figure 2:
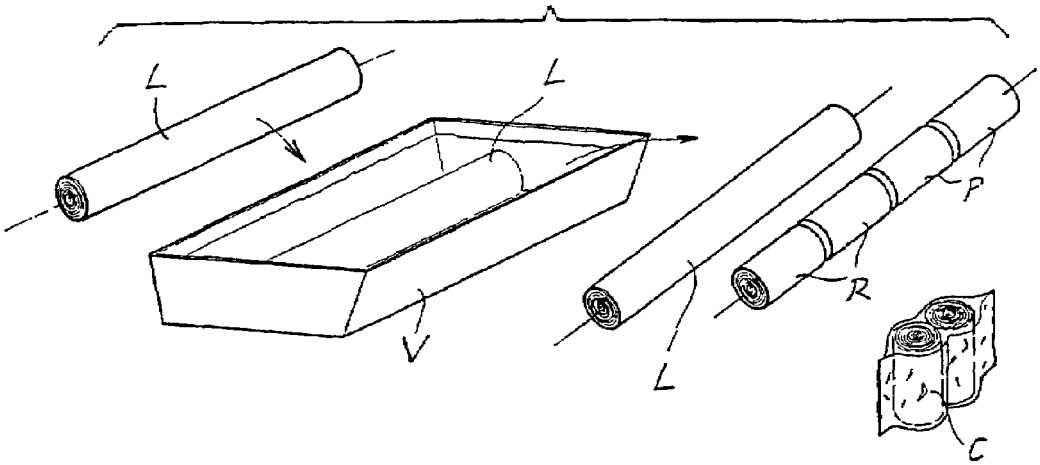
FIG. 2 shows a diagram of the stages of processing after winding, in a first embodiment.

FIG. 2 shows schematically the process in which the logs L are first soaked with liquid and then cut into a plurality of small rolls R which are packaged, for example, in multiple packs C, produced in a suitable way. The packs can consist of welded plastic sachets, rigid or semi-rigid boxes or containers, or other suitable packaging systems, which may depend on the final destination of the product.

The stage of wetting the logs is shown schematically by the movement of the logs L into a tank V containing the water or other liquid component. This movement can be provided, for example, by placing the logs on a store or buffer unit consisting of a chain conveyor with cradles for supporting the logs, of the type conventionally used in production lines for rolls of toilet paper or other products, and by having at least one portion of the chains carrying the supporting cradles for the logs in transit running within a tank or other reservoir V containing the liquid with which the logs are to be soaked or with which they are to be wetted.

The soaked or moistened logs are then cut into small rolls R by means of a cutting device or shear (not shown), and packaged in a known way.

Figure 3:
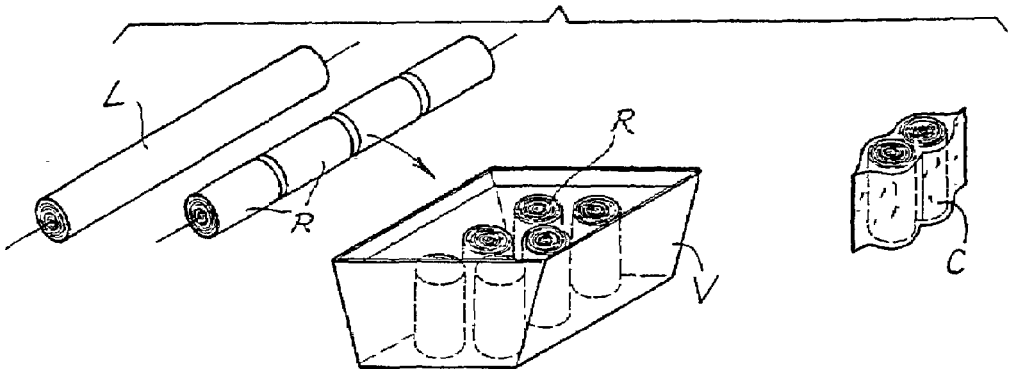
FIG. 3 shows a diagram similar to that of FIG. 2, in a modified embodiment.

FIG. 3 shows in a highly schematic way a process similar to the preceding one, in which the logs are cut into small rolls R before being soaked or moistened with the liquid phase. In this case, it is the rolls R that are passed through the reservoir or tank V to receive the liquid and be wetted before being packaged. This solution has the advantage of simplifying processing, because in this case the wound material is cut into small rolls while it is still dry.

It is to be understood that the drawing shows only an example provided solely as a practical demonstration of the invention, and that this invention can be varied in its forms and arrangements without departure from the scope of the guiding concept of the invention.

What is claimed is:

1. A method for producing rolls of web material, wound and moistened with a liquid-based mixture, comprising the stages of:

feeding the web material toward a winding area;

applying to said fed web material, upstream from the winding area, at least one dry component or a component with a liquid content low enough so as to not substantially reduce mechanical strength of the web material and thereby allow feeding of the web material to the winding area;

winding, in said winding area, the web material to which the aforesaid component has been applied, to form a roll of web material;

moisten the wound web material by adding a second liquid to the wound web material, prior to product packaging of the wound web material and in the absence of unwinding of said wound web material, to provide the second liquid from periphery to core of the wound web material;

and then packaging the wound and moistened web material.

2. The method according to claim 1, wherein said component is selected from a group comprising: soaps, perfume essences, disinfectants, oils, emollient products, or combinations of these.

3. The method according to claim 1 or 2, wherein said component is applied by spreading on at least one of the two faces of the web material.

4. The method according to claim 1, wherein the roll of wound web material is moistened and then cut into small rolls.

5. A method for producing rolls of web material, wound and moistened with a liquid-based mixture, comprising the stages of:

feeding the web material toward a winding area;

applying to said fed web material, upstream from the winding area, at least one dry component or a component with a liquid content low enough so as to not substantially reduce mechanical strength of the web material and thereby allow feeding of the web material to the winding area;

winding, in said winding area, the web material to which the aforesaid component has been applied, to form a roll of wound web material;

moisten the web by adding a second liquid to the wound web material in the absence of unwinding of the wound web material, to provide the second liquid from periphery to core of the wound web material; and after the moistening, packaging said wound web material while still wet.

6. The method according to claim 1, wherein the roll of wound web material is cut into small rolls and the small rolls are then moistened with said second liquid.

7. Equipment for producing rolls of wound web material, comprising a feed path for the web material; winding means for winding said web material and forming said rolls; an applicator member, along said feed path and upstream of said winding means, for applying to the web material fed along said path a dry component or a component with a liquid content low enough so as to not substantially reduce mechanical strength of the web material and thereby allow feeding of the web material to the winding means; and wetting means located downstream from said winding means for wetting the wound web material with a second liquid from periphery to core prior to subjecting the wound web material to product packaging apparatus and in the absence of subjecting the wound web to an unwinder; and providing the product packaging apparatus downstream of the wetting means.

8. The equipment according to claim 7, wherein said applicator member comprises doctor means for spreading said component.

9. The equipment according to claim 7, wherein a cutter is located downstream from said winding means for cutting the rolls of web material into small rolls.

10. The equipment according to claim 9, wherein said cutter is located upstream from said wetting means.

11. The equipment according to claim 9, wherein said cutter is located downstream from said wetting means.

* * * * *